US007922023B2

(12) United States Patent
Dommerholt

(10) Patent No.: US 7,922,023 B2
(45) Date of Patent: Apr. 12, 2011

(54) RECEPTACLE FOR A CONTAMINANT

(75) Inventor: Johan Dommerholt, Lochemseweg (NL)

(73) Assignee: Combicraft Enterprises Inc. (HK), Yaumatei-Kowloon (HK)

( * ) Notice: Subject to any disclaimer, the term of this patent is extended or adjusted under 35 U.S.C. 154(b) by 284 days.

(21) Appl. No.: 12/048,486

(22) Filed: Mar. 14, 2008

(65) Prior Publication Data

US 2008/0221544 A1 Sep. 11, 2008

Related U.S. Application Data

(63) Continuation of application No. PCT/CN2006/002345, filed on Sep. 11, 2006.

(30) Foreign Application Priority Data

Sep. 14, 2005 (CN) ..... 2005 1 099345

(51) Int. Cl.
*B65D 35/14* (2006.01)
*B65D 41/02* (2006.01)
*B65D 25/14* (2006.01)

(52) U.S. Cl. ..... 220/262; 220/252; 220/260; 220/263; 220/495.06; 220/908; 220/908.1

(58) Field of Classification Search .... 220/23.86–23.88, 220/252, 260, 262, 263, 495.06, 500, 501, 220/505, 694, 810, 908, 908.1, FOR. 192; 206/363–365; 604/385.13
See application file for complete search history.

(56) References Cited

U.S. PATENT DOCUMENTS 5,046,614 A * 9/1991 Torres et al. ..... 206/366
5,651,231 A * 7/1997 Garland ..... 53/258
2007/0125792 A1* 6/2007 Pollack et al. ..... 220/908.2

FOREIGN PATENT DOCUMENTS

WO WO-96/06788 3/1996

* cited by examiner

*Primary Examiner* — Anthony Stashick
*Assistant Examiner* — Madison L Wright
(74) *Attorney, Agent, or Firm* — Patterson & Sheridan, L.L.P.

(57) ABSTRACT

An apparatus for receiving and storing a soiled item has a container and a cover, which can be rotated about spindles. The cover comprises a casing in which a movable body can move to and fro. The moveable body is placed inside a compartment at the closed end of a flexible holder. A soiled item can be put inside the casing and subsequently the cover can be rotated around spindles. The moveable body will fall downwards under the force of gravity, pushing the soiled item inside the container. The flexible holder is fixed inside the casing with a firm closed elastic band at the location of the rim of its open end.

15 Claims, 4 Drawing Sheets

RECEPTACLE FOR A CONTAMINANT

CROSS-REFERENCE TO RELATED APPLICATIONS

This application is a continuation of co-pending international patent application no. PCT/CN2006/002345, filed Sep. 11, 2006, which claims benefit of Chinese patent application serial number 200510099345.8, filed Sep. 14, 2005. Each of the aforementioned related patent applications is herein incorporated by reference.

BACKGROUND OF THE INVENTION

1. Field of the Invention

The present invention relates to apparatus for moving an item from one location to another location, in particular for receiving and storing a soiled item, in particular a soiled diaper, which apparatus comprises a container and a cover, the cover comprising a casing in particular a hollow cylinder having at least one open end, the casing holding a movable body above which the item can be placed, whereby the cover is rotatable around a rotation axis between a first position and a second position, urging the movable body to move inside the casing under the force of gravity thereby assisting the item to move out of the casing into the container.

2. Description of the Related Art

Such an apparatus is known from international patent application WO96/06788. The known apparatus is a container for soiled items such as diapers with a turnable and at least partially cylinder-shaped cover. The covet can be rotated about 180 degrees. The casing is embodied as a cylinder and the movable body as a piston caught in the cylinder, which can move to and fro in the cylinder. When the cover of the known apparatus is in the first position, the item can be placed in the cylinder. Subsequently, the cover can be rotated to the second position. Under the force of gravity, the piston will move downwards thus pushing the item into the container. The cylinder has two open ends, so an item can be placed in it, no matter if the cover is in the first or the second position. Rubber O-rings on the piston prevent the smell of the soiled items from escaping the container.

Such a container is generally used for storing diapers or used bandages in hospitals and child day care centres. The users of the container typically throw away such soiled items several times a day. Any inconvenience in use will be felt strongly by these frequent users.

One drawback of the known apparatus is the fact that it is difficult to clean the cylinder and the piston, which usually both have contact with a soiled item being moved into the container. Because the piston has a close fit in the cylinder and cannot be removed, cleaning is not easy to accomplish.

SUMMARY OF THE INVENTION

The present invention has for its object, inter alia to provide an apparatus of the type stated in the preamble, which can be cleaned more easily and thoroughly. In order to achieve the stated objective, an apparatus of the type stated in the preamble according to the invention has the feature that a flexible holder, having at least one open end with a rim and one closed end, is present in the casing. In this way, the inner surface of the casing is protected against dirt rubbing of from the soiled item. The flexible holder can comprise a sack or sock made out of a proper material, which is able to fold in and out, following the movements of the body.

A preferred embodiment of the apparatus has the feature according to the invention that the open end of the flexible holder is detachably fixed to the cover. Due to this measure, it is possible to temporarily take the flexible holder out of the casing and clean it.

A further preferred embodiment of the apparatus has the feature according to the invention that the open end of the flexible holder is attached to an inner circumference of the casing, which is positioned at least substantially halfway casing. Thus the full length of the casing could be used to put an item in and bigger or more items could be thrown away in one go. The flexible holder could fold out in two directions, following the body moving to and fro in the casing.

According to yet another embodiment, the apparatus according to the invention has the feature that the flexible holder at the location of its rim, comprises a firm closed elastic band, in particular a ring. In this way, the flexible holder can be easily placed in and removed from the casing. The firm closed elastic band can be folded while putting the flexible holder in place. Inside the casing the firm closed elastic band will stretch out against the inner circumference and jam against it.

Another embodiment of the apparatus has the feature according to the invention that the casing is provided with a groove along an inner circumference, to receive the rim of the flexible holder. This measure allows the rim, whether or not provided with a firm closed elastic band, to stay jammed at an at least substantially fixed position, which allows more reliable functioning.

A preferred embodiment of the apparatus according to the invention has the feature that the movable body is fixed to the flexible holder. In this way, it is possible to use a movable body of a smaller size. As it is fixed to the flexible holder. It will not fall out of the casing. Another advantage of this embodiment is the fact that the flexible holder will fold out properly, following the movements of the body very well. This will allow the item to be put into the flexible holder more conveniently. A third advantage is the fact that the movable body, being small, can be taken out of the casing together with the flexible holder. Thus the movable body, the flexible holder and the casing can be cleaned very well. This allows the use of just one flexible holder in a two-way system. The holder will have about half the length of the casing and can follow the body moving to and fro between two open ends of the casing. In the first as well as the second position of the cover, the full length of casing can be used to put an item in. The dirt rubbing of on the inner surface of the casing and on the flexible holder and movable body can be easily cleaned away in the manner described above.

Yet another embodiment of the apparatus has the feature according to the invention that the movable body is detachably fixed to the flexible holder. This allows even better cleaning, as the flexible holder and the movable body can be cleaned separately. In this way it is also possible to clean the flexible holder and the movable body in different ways, appropriate for the shape and material used in them.

A particular embodiment of the apparatus has the feature according to the invention that the flexible holder comprises a compartment near its closed end, in which the movable body can be placed. In this way it is possible to keep the movable body clean. Just the flexible holder will become dirty during use and has to be cleaned.

Another particular embodiment of the apparatus has the feature according to the invention that the casing has an at least substantially tapered longitudinal cross-section, the smallest transversal cross-section being located at least almost nearest to the open end. This shape will allow better passing of the movable body and the flexible holder. During passage through the middle of the casing, the flexible holder will be folded in and will pass easier, when some extra space is present.

The invention also relates to a flexible holder for use in an apparatus according to any one of the preceding claims.

Another disadvantage of the known apparatus is the fact that the casing has at least one sharp edge. The edge is namely folded inwards, to provide a natural stop for the piston, preventing it from escaping the casing unwantedly.

The present invention has for its object, inter alia to provide an apparatus of the type stated in the preamble, which does not have a sharp edge. In order to achieve the stated objective, an apparatus of the type stated in the preamble according to the invention has the feature that the casing is provided with a flexible stopper, along an edge of its open end, which stopper has an inner circumference which is smaller than the inner circumference of the edge of the casing.

A particular embodiment of the apparatus has the feature according to the invention that the flexible stopper comprises a groove and the edge of the casing comprises a corresponding ridge to allow the stopper to be snapped onto the edge. In this case the stopper can be placed and removed easily, which allows easy cleaning of the stopper itself and the casing. It also allows a bigger movable body to be taken out and cleaned.

Another particular embodiment of the apparatus has the feature according to the invention that the flexible stopper comprises a ridge and the edge of the casing comprises a corresponding groove to allow the stopper to be snapped onto the edge. In this case also the stopper can be placed and removed easily, which allows easy cleaning of the stopper itself and the casing. It also allows a bigger movable body to be taken out and cleaned.

A drawback disadvantage of the known apparatus is the fact that the cover is not easily removable. It is fixed to the container with at least two screws, which have to be loosened. Because of this it is not easy to clean the apparatus.

The present invention has for its object, inter alia to provide an apparatus of the type stated in the preamble, of which the cover can be removed easily. In order to achieve the stated objective, an apparatus of the type stated in the preamble according to the invention has the feature that the cover comprises outwardly protruding projections at opposite sides and the container comprising corresponding indentations in which the outwardly protruding projections rest. In this case, the cover can be just lifted from the container.

Yet another disadvantage of the known apparatus is the fact that it is not easy to empty the container, as the container has an upper part, which is clicked to a lower part along its entire edge. Because of this both hands have to be used a considerable force must be applied to open the container.

The present invention has for its object, inter alia to provide an apparatus of the type stated in the preamble, of which the container can be emptied easily. In order to achieve the stated objective, an apparatus of the type stated in the preamble according to the invention has the feature that the container comprises an upper segment, which is rotatably attached to a lower segment, which upper segment is lockable to the lower segment with a snap closure, the snap closure being provided with a push release button. In this case, the container can be opened using just one hand, by pushing the button.

A disadvantage of the known apparatus is the fact that the container uses up a considerable space, also when the apparatus is not yet in use. This requires unnecessary storage space.

The present invention has for its object, inter alia to provide an apparatus of the type stated in the preamble, which can be stored using less storage space. In order to achieve the stated objective, an apparatus of the type stated in the preamble according to the invention has the feature that the container comprises at least a first and a second segment. The first and the second segment can be stored more effectively. When the container has a slightly tapered shape, the first segment can be for instance be placed inside the second one, reducing the space required to store them.

A particular embodiment of the apparatus has the feature according to the invention that the first and the second segment are releasably connected to each other. In this case, the two segments could be taken apart again after assemblage, so an end-user could temporarily store the apparatus in a smaller space, when not in use.

Another particular embodiment of the apparatus has the feature according to the invention that the first and the second segment are releasably connected to each other by means of a snap connection. This allows easy assemblage and disassemblage.

A disadvantage of the known apparatus is the fact that the container, when provided with a waste bag, cannot be emptied easily. The container has to be opened at an upper side, and the full waste bag has to be lifted out.

The present invention has for its object, inter alia to provide an apparatus of the type stated in the preamble, which can be emptied more easily when a waste bag is present inside the container. In order to achieve the stated objective, an apparatus of the type stated in the preamble according to the invention has the feature that the container comprises a bottom part comprising a wall part and a detachable floor. The floor can be detached from the rest of the container, which rest can be lifted, while the waste bag stays on the detached floor. The waste bag can be easily carried away in this case.

A preferred embodiment of the apparatus has the feature according to the invention that the detachable floor comprises a lifting mechanism with a pedal which, when operated, lifts the wall part, thereby separating the wall part and the floor. This construction allows the floor to be separated from the rest of the container more easily and conveniently. The pedal can be operated by one foot, while the hands are kept free to take the waste bag out.

Another preferred embodiment of the apparatus has the feature according to the invention that characterized in that the container has a tapered shape, the cross-section of it being at least almost largest near the floor. This measure allows the container to be taken form the waste bag without problems. The full waste bag has a much smaller chance of getting stuck in the container.

Another drawback of the known apparatus is the fact that the container is quite low and a user needs to bow forward when putting an item in the casing. When the apparatus is used a lot, like in a child day care centre or a hospital, the frequent bowing may cause back problems.

The present invention has for its object, inter alia to provide an apparatus of the type stated in the preamble, which does not require a lot of bowing by a user. In order to achieve the stated objective, an apparatus of the type stated in the preamble according to the invention has the feature that the container is provided with a mounting element for mounting it to a wall. Thus, the apparatus can be installed on a height, which is convenient for the users.

A particular embodiment of the apparatus has the feature according to the invention that the mounting element is detachable. In this case the mounting element can be fixed to the wall and the apparatus can be put on and taken of whenever necessary.

Another embodiment of the apparatus has the feature according to the invention that the mounting element comprises at least one opening for passing through a fixing element. In this case for instance a nail or screw can be easily used to mount the element.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
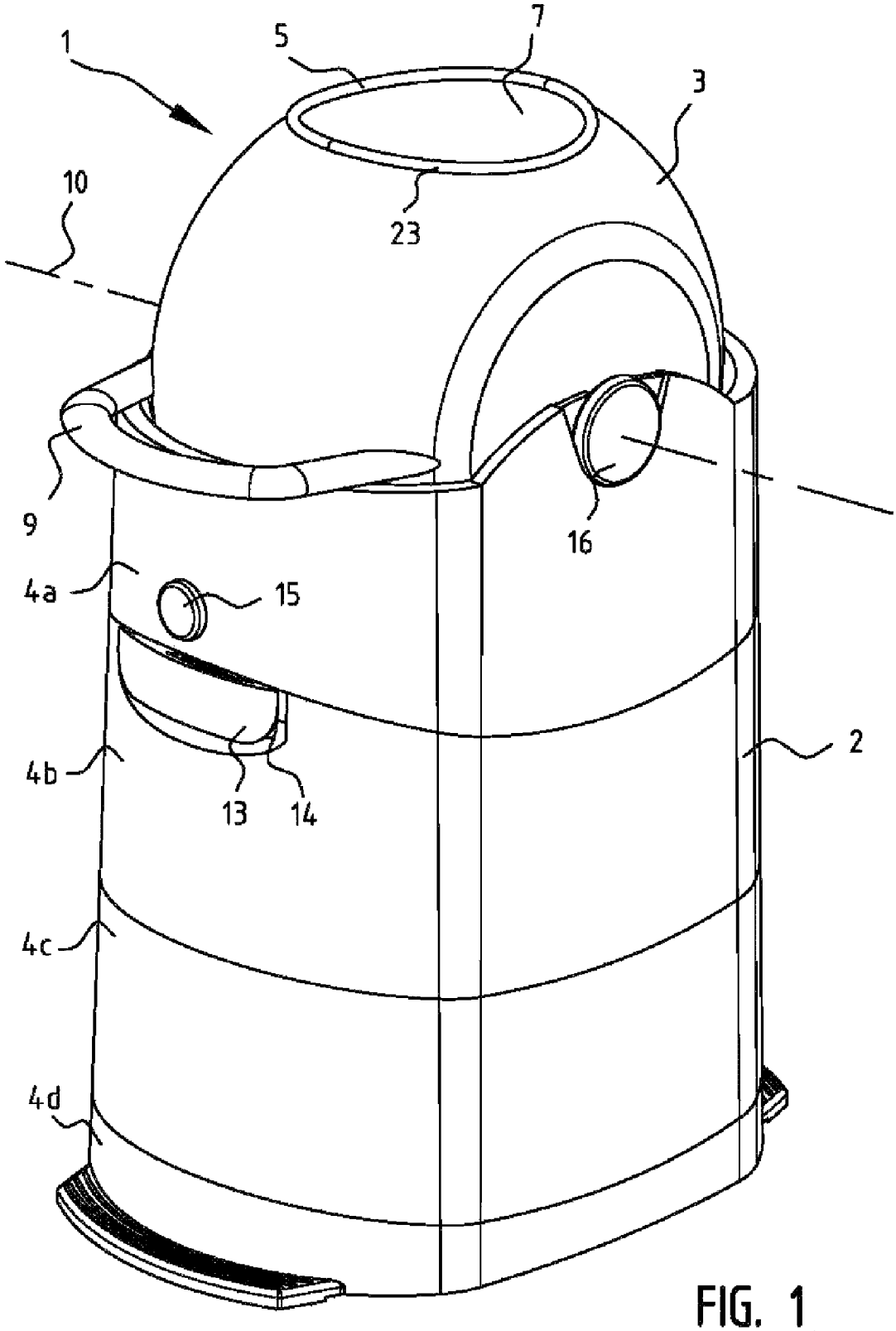
FIG. 1 shows a schematic perspective view of a preferred embodiment of the apparatus according to the invention.

FIG. 1 shows a schematic perspective view of a preferred embodiment of the apparatus according to the invention. An apparatus (1) is shown, which is made out of plastic and in which a soiled item (not shown) can be received and stored. Of course several items could be received and/or stored at the same time. In particular diapers for children or grown ups can be received and stored. The apparatus comprises a container (2) and a cover (3). The container is built up of four mounted segments (4*a*, 4*b*, 4*c*, 4*d*), the lower segment (4*d*) in effect being the bottom of the container (2). The cover (3) is provided with a casing (7), in this case embodied as a cylinder, the casing having two open ends (5, 6). A movable body (8), shaped as a piston, can move in the casing (7). The movement will be elucidated further in the FIGS. 2 and 3. The cover (3) can be rotated with respect to the container between a first and a second position, around rotational axis (10), in this case a hinge connection. The rotation of the cover can be accomplished by operating it manually, using a handle (9). When the cover (3) is in the first position, a soiled item like a soiled diaper can be thrown into the casing (7). In the second position, the movable body (8) may fall downwards inside the casing (7) under the force of gravity, thereby pushing the soiled item into the container (2). Then the same process can be repeated in the other direction. As the movable body (8) has fallen downwards, it is possible to throw another soiled item into the casing (7) when the cover is in the second position.

Figure 2:
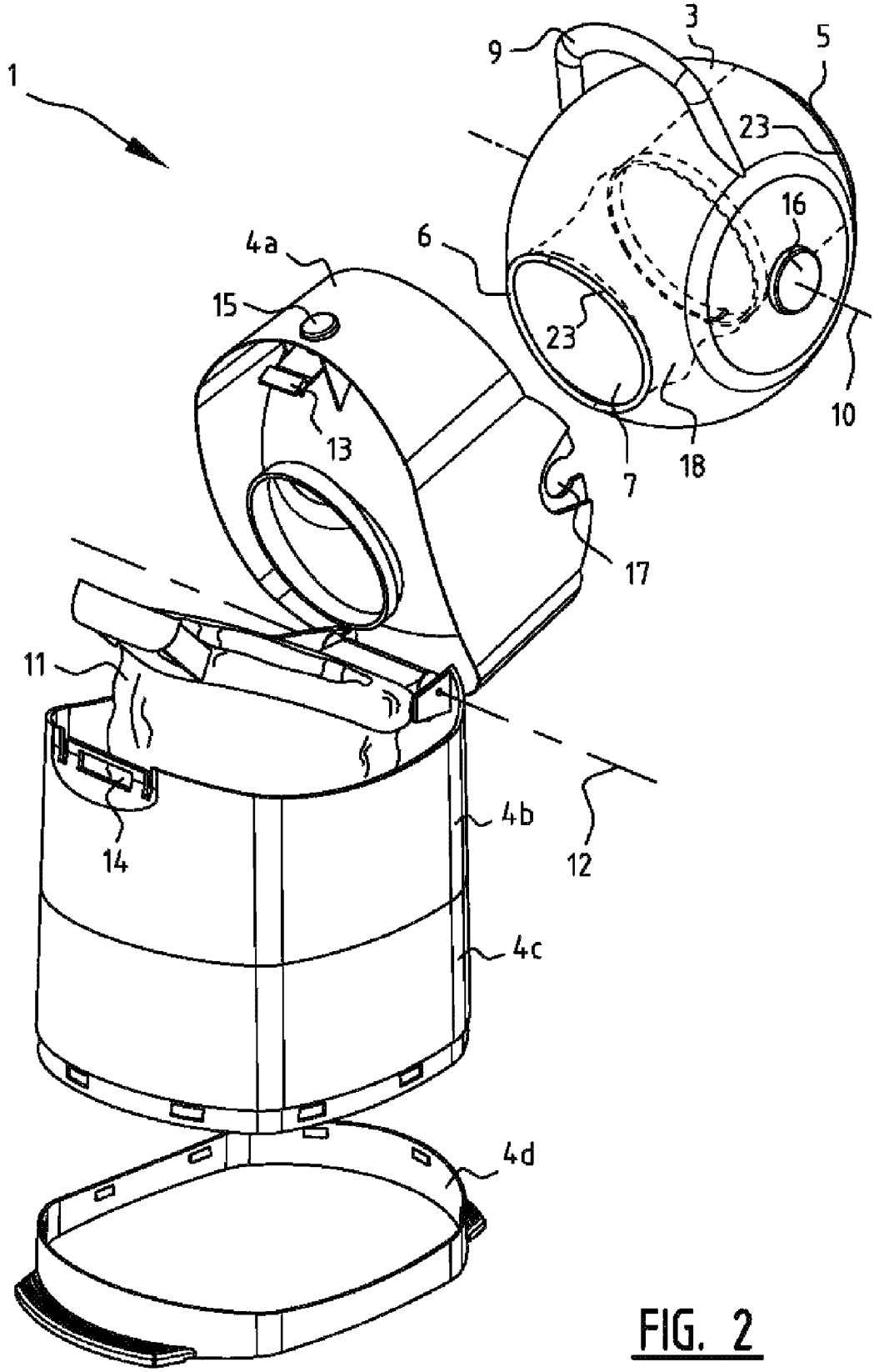
FIG. 2 shows an exploded view of the apparatus as shown in FIG. 1.

FIG. 2 shows an exploded view of the apparatus as shown in FIG. 1. Segment (4*b*) of the container (2) is embodied as a support for a bag (11) made out of a flexible material, such as a waste bag. In this bag, soiled items, received by the apparatus (1) will be held. From time to time, the bag (11) needs to be replaced. To facilitate this, segment 4*a* can be rotated with respect to segment (4*b*) around rotational axis (12) in this case a hinge connection, thus opening the container (2) as shown in FIG. 2. After replacing the bag (11), segment (4*a*) can be rotated back into its Currently Amended position, around rotational axis (12), thus closing the container (1) again.

The container (2) is locked by a snap closure. This snap closure comprises a lip (13) on segment (4*a*) and a corresponding opening (14) in segment (4*b*). When the container (2) is closed, the lip (13) will click into the opening (14), thereby locking the container (2). A push release button (15) is provided to unlock the container again.

The cover (3) is provided with outwardly protruding projections (16) at opposite sides, which outwardly protruding projections (16) fit into corresponding indentations (17) in the container (2), where they rest when the cover (3) is placed on the container (2). The outwardly protruding projections (16) and the corresponding indentations (17) form spindles and bearings, about which the cover can rotate.

Casing (7) is at its inside provided with a flexible holder (18), in this case a cylinder-shaped bag, having an one open end with a rim and a closed end.

The two open ends (5, 6) of the casing (7) are provided along their edge with a flexible stopper (23), in this case a rubber ring. Of course any other suitable material can be chosen.

Figure 3C:
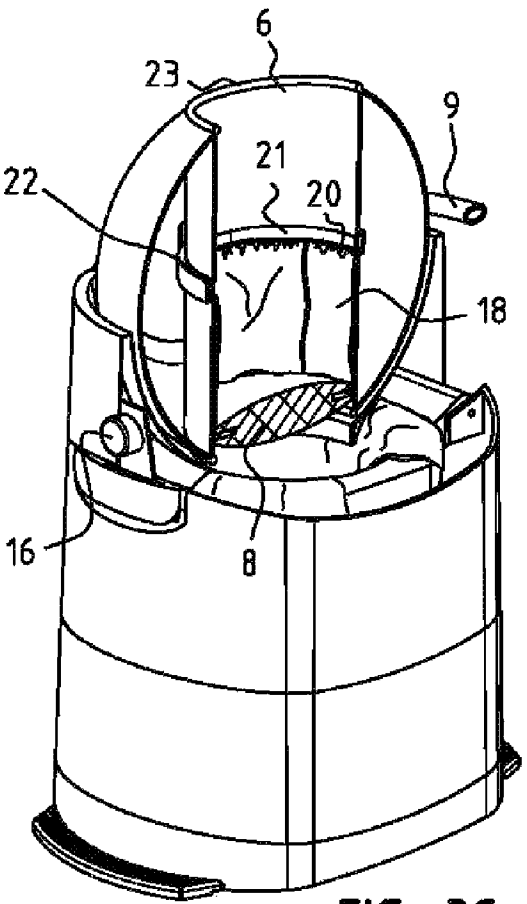
FIG. 3*a*-3*c* represents cutaway side views showing modes of operation of the apparatus of FIGS. 1 and 2.
Figure 3B:
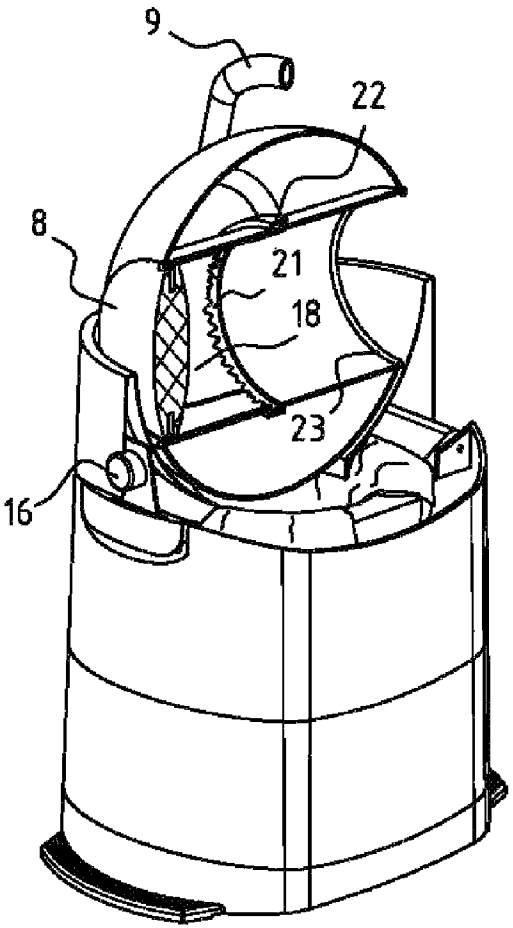
Figure 3A:
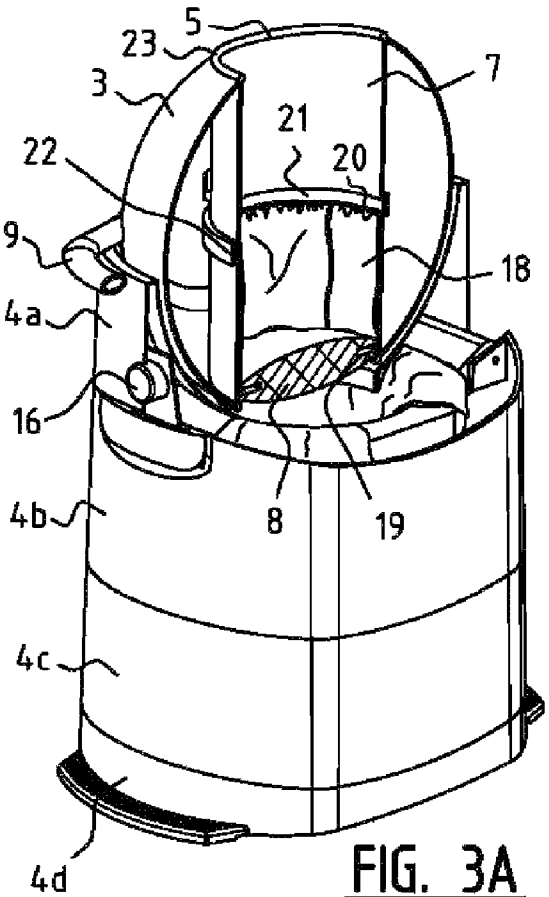

FIGS. 3*a*-3*c* represent cutaway side views showing modes of operation of the apparatus (1) of FIGS. 1 and 2. The functioning of the apparatus (1) is shown as it were step by step, the container (2) and cover (3) being represented in partly cutaway view, for clarity. The flexible holder (18) is provided at the inside of the casing (7). The movable body (8), in this case a disk, is placed inside a compartment (19) near the closed end of the flexible holder (18). At its open end, the flexible holder (18) is at the location of its rim (20) provided with a firm closed elastic band (21), in this case a springy ring. The firm closed elastic band (21) is fitted into a corresponding groove (22) along an inner circumference of the casing (7). The flexible holder (18) can be easily put into and taken out of the casing (7), by pressing in the firm closed elastic band (21) and let it spring out again inside the casing (7) at the location of the groove (22). So when the flexible holder (18) and/or the casing (7) would be dirty, the flexible holder (18) could readily be taken out of the casing and the movable body (8) can be taken out of the compartment (19). In this case, all parts can be cleaned separately, which is very practical. Alternatively, the flexible holder (18) could be replaced as throwaway part.

In FIG. 3*a*, the cover (3) is shown in the first position, in which the soiled item can be thrown into the casing (7) via open end (5). By operating the handle (9) as shown in FIGS. 1 and 2, the cover (3) can be rotated around rotational axis (10) from the first position (as shown in FIG. 3*a*) to the second position (as shown in FIG. 3*c*). In FIG. 3*b* a position halfway the rotation from the first position to the second position is shown. The movable body (8) will fall under the force of gravity and push the soiled item through open end (6) into the container (2). As the casing (7) has two open ends (5, 6), the cover (3) in the second position will be able to readily receive another soiled item.

Figure 4:
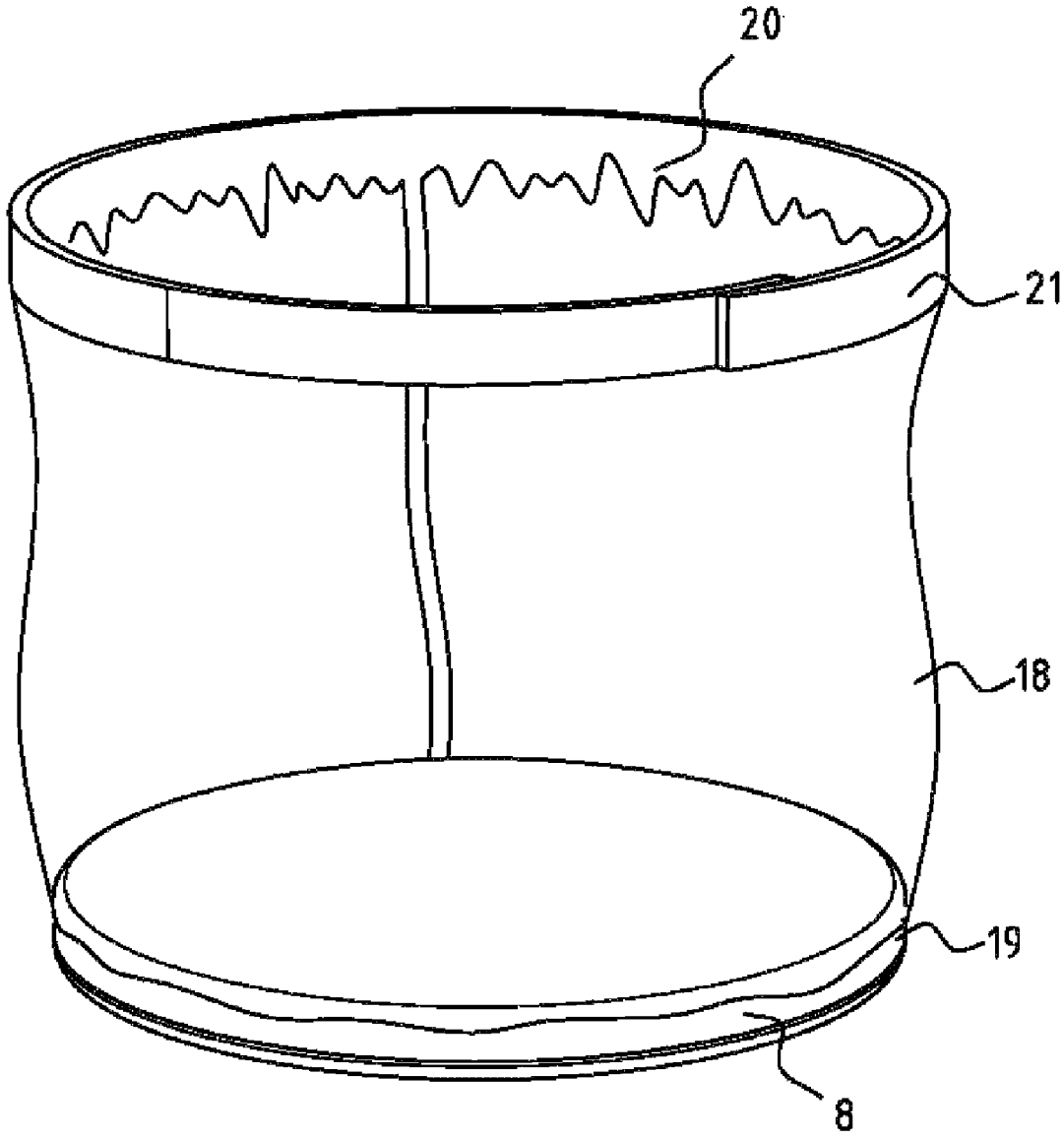
FIG. 4 is concerned with a schematic perspective view of a part of the apparatus of FIGS. 1, 2 and 3.

FIG. 4 is concerned with a schematic perspective view of a part of the apparatus (1) of FIGS. 1, 2 and 3. The part shown is the flexible holder (18) provided with a firm closed elastic band (21) at the location of its rim (20). The movable body (8) is placed in the compartment (19). The firm closed elastic band (21) in this case is a springy ring.

Although in the preceding, the invention is elucidated with use of the drawing, it should be stated explicitly, that the invention is by no means limited to the embodiment as shown in the figures. The invention also relates to all other embodiments within the scope as defined by the claims.

For instance, different materials and geometries can be used for the several parts of the apparatus (1). The casing (7) could for instance be square or have a non-constant cross-section. It may be for instance tapered in shape. The movable body (8) can have several shapes, fitting inside the casing (7) used.

While the foregoing is directed to embodiments of the present invention, other and further embodiments of the invention may be devised without departing from the basic scope thereof, and the scope thereof is determined by the claims that follow.

The invention claimed is:

1. An apparatus for moving an item from one location to another location, in particular for receiving and storing a soiled item, in particular a soiled diaper, which apparatus comprises a container and a cover, the cover comprising a casing in particular a hollow cylinder having at least one open end, the casing holding a movable body above which the item can be placed, whereby the cover is rotatable around a rotation axis between a first position and a second position, urging the movable body to move inside the casing under force of gravity thereby assisting the item to move out of the casing into the container, wherein a flexible holder, having at least one open end with a rim and one closed end, is present in the casing.

2. The apparatus according to claim 1, wherein the open end of the flexible holder is detachably fixed to the cover.

3. The apparatus according to claim 1, wherein the flexible holder is attached to an inner circumference of the casing, which is positioned at least substantially halfway in the casing.

4. The apparatus according to claim 2, wherein the flexible holder at the location of its rim, comprises a firm closed elastic band, in particular a ring.

5. The apparatus according to claim 2, wherein the casing is provided with a groove along an inner circumference, to receive the rim of the flexible holder.

6. The apparatus according to claim 1, wherein the movable body is fixed to the flexible holder.

7. The apparatus according to claim 1, wherein the movable body is detachably fixed to the flexible holder.

8. The apparatus according to claim 1, wherein the flexible holder comprises a compartment near its closed end, in which the movable body can be placed.

9. The apparatus according to claim 1, wherein the casing has an at least substantially tapered longitudinal cross-section, and wherein a smallest transversal cross-section is located proximate the open end.

10. The apparatus according to claim 1, wherein the casing is provided with a flexible stopper, along an edge of its open end, which stopper has an inner circumference which is smaller than an inner circumference of the edge of the casing; said flexible stopper comprises a groove and the edge of the casing comprises a corresponding ridge to allow the stopper to be snapped onto the edge.

11. The apparatus according to claim 1, wherein the casing is provided with a flexible stopper, along an edge of its open end, which stopper has an inner circumference which is smaller than an inner circumference of the edge of the casing; said flexible stopper comprises a ridge and the edge of the casing comprises a corresponding groove to allow the stopper to be snapped onto the edge.

12. The apparatus according to claim 1, wherein the container comprises an upper segment, which is rotatably attached to a lower segment, which upper segment is lockable to the lower segment with a snap closure, the snap closure being provided with a push release button.

13. The apparatus according to claim 1, wherein the container comprises a bottom part comprising a wall part and a detachable floor.

14. The apparatus according to claim 13, wherein the detachable floor comprises a lifting mechanism with a pedal which, when operated, lifts the wall part, thereby separating the wall part and the floor.

15. The apparatus according to claim 13, wherein the container has a tapered shape, and wherein a cross-section of it being at least almost largest near the floor.

* * * * *